US006712337B1

(12) United States Patent
Wiklund

(10) Patent No.: US 6,712,337 B1
(45) Date of Patent: Mar. 30, 2004

(54) HOIST SYSTEM

(75) Inventor: Sven-Erik Wiklund, Skelleftea (SE)

(73) Assignee: Alimak AB, Skelleftea (SE)

( * ) Notice: Subject to any disclaimer, the term of this patent is extended or adjusted under 35 U.S.C. 154(b) by 0 days.

(21) Appl. No.: 10/129,260

(22) PCT Filed: Nov. 1, 2000

(86) PCT No.: PCT/SE00/02146

§ 371 (c)(1),
(2), (4) Date: Aug. 19, 2002

(87) PCT Pub. No.: WO01/32544

PCT Pub. Date: May 10, 2001

(30) Foreign Application Priority Data

Nov. 4, 1999 (SE) ..... 9904011

(51) Int. Cl.[7] ..... B66D 1/00
(52) U.S. Cl. ..... 254/266
(58) Field of Search ..... 254/266

(56) References Cited

FOREIGN PATENT DOCUMENTS

| | | | |
|---|---|---|---|
| DE | 267488 A | 9/1911 | |
| DE | 4406987 C1 | 7/1995 | |
| FR | 696909 A | 1/1931 | |
| SE | 462336 B | 6/1990 | |
| WO | WO 00/50167 | * 10/1999 | |

* cited by examiner

*Primary Examiner*—Emmanuel Marcelo
(74) *Attorney, Agent, or Firm*—Nixon & Vanderhye, P.C.

(57) ABSTRACT

A hoist system comprises at least one mast (2), a hoist trolley (4) moveable externally along the mast, and a platform (24), which is articulately coupled to the hoist trolley (4) so that it is horizontally pivoting about a substantially vertical axis (22) between two end positions relative to the hoist trolley (4). The position of the vertical axis (22) is adjustable for adjusting the distance between the hoist trolley (4) and the platform (24). As a result, the mast can be anchored in a traditional manner at one of the two facade sections of a building extending from a non-right-angled corner, and the platform can be angled horizontally relative to the hoist trolley so that it extends substantially in parallel with the other facade section of the building.

8 Claims, 4 Drawing Sheets

HOIST SYSTEM

Figure 1:
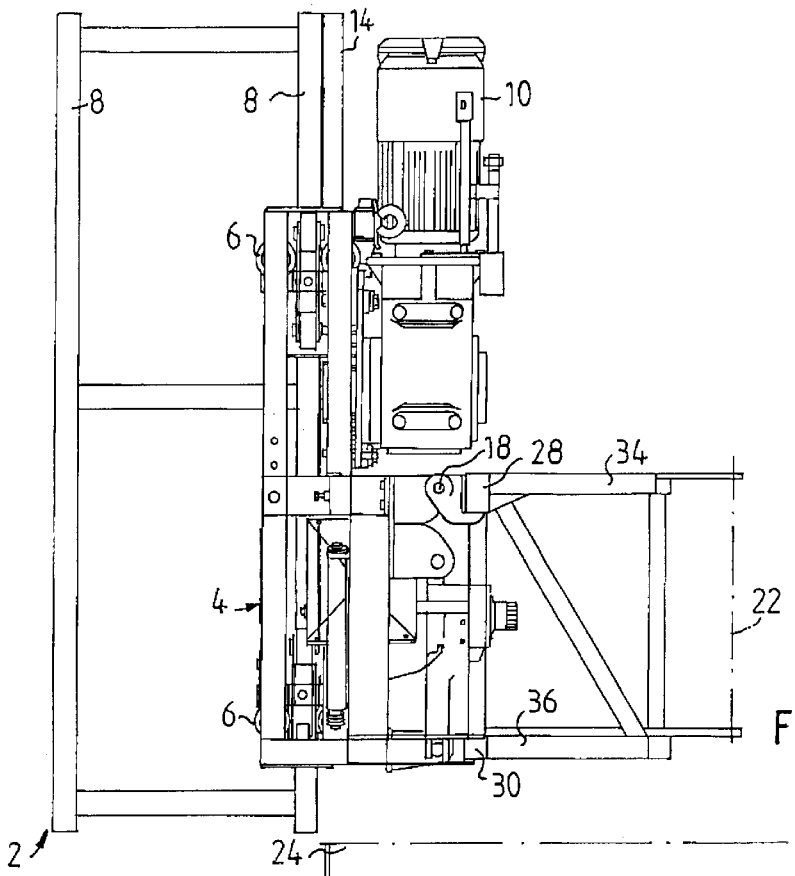

This application is the U.S. national phase of international application PCT/SE00/002146 filed Nov. 1, 2000, which designated the U.S.

The present invention relates to a hoist system, comprising at least one mast, a hoist trolley moveable externally along the mast, and a platform, which is articulately coupled to the hoist trolley so that it is horizontally pivoting about a substantially vertical axis between two end positions relative to the hoist trolley. The vertical axis is situated between the hoist trolley and the platform, as seen horizontally.

When renovating or constructing buildings, a hoist system of this kind provides transport of personnel and materials to and from the various landings of the building. The hoist system may also be utilised for work on the facade of the building by allowing building workers to stand on the platform when working. To make the entire facade of the building accessible from the platforms often a great number of masts with intermediate mediate platforms has to be placed in a row along the facade of the building, since for strength and security reasons each platform has a limited length. The hoist system may also be utilised in permanent installations for the maintenance of larger machines.

One type of platform typically used for work on building facades comprises smaller sections which can be interconnected to form an assembled rectangular platform with a suitable length. The assembled platform is coupled with its two short ends to two hoist trolleys running along two adjacent masts between which the platform extends.

In a known hoist system several masts can be arranged in a straight row along a straight building facade with platforms coupled between hoist trolleys of adjacent masts. This results in the advantage that the number of masts required along the building facade are minimised, since each mast, except the first and last mast in said row of masts, is utilised for carrying two platforms at mutual sides of the mast. In the known hoist system it is also possible to form a right-angled mast arrangement, in which the last mast in a straight mast row constitute the first mast in another mast row running perpendicular from the first mentioned mast row, i.e. said first and last mast constitute a mast common to both mast rows. Thus, the mast rows form one single continuous row of masts interconnected by the platforms.

In the known hoist system described above the common mast may have only one hoist trolley, which is coupled to a platform extending along the first mentioned mast row and to another platform extending along the last mentioned mast row. Alternatively the common mast may have two hoist trolleys, one of which is coupled to the platform which extends along the first mentioned mast row and the other hoist trolley of which is coupled to a platform extending along the last mentioned mast row. The described right-angled mast arrangement is suited for such ordinary facade sections which extend perpendicularly to each other and end in a corner. The common mast of course is placed at such a corner.

However, there are buildings with facade sections that form non-right-angled corners between adjacent facade sections, usually obtuse-angled corners, i.e. having angles between 90 and 180°. In contrast to the case described above with only one mast at each right-angled corner, in a building of this kind two masts, one in each mast row, must be placed closed to each other at the non-right-angled corner to be coupled to two adjacent platforms extending along respective facade sections.

The reason for this is that known hoist systems currently available on the market do not admit that one platform is carried by two adjacent masts which are turned relative to each other with an angle corresponding to the obtuse angle between adjacent facade sections. If the building has many such non-right-angled corners the costs for installation of twin masts at the corners may be significant, in particular when considering that each mast has to be equipped with a hoist trolley and a drive unit for driving the latter along the mast.

An object of the present invention is to provide a hoist system that allows installation of one single mast at a non-right-angled corner of for instance a building or a larger machine and installation of platforms extending from one or two hoist trolleys on the mast substantially in parallel with the facade sections forming the non-right-angled corner.

Another object of the invention is to provide a versatile hoist system allowing installation of a continuous row of masts and platforms along a facade including facade sections forming non-right-angled as well as right-angled corners.

These objects are achieved by means of a hoist system of the kind stated initially, which is characterised in that the position of the vertical axis is adjustable for adjusting the distance between the hoist trolley and the platform. Hereby the mast may be placed at a non-right-angled corner of a building and be anchored in a traditional manner at one of the two facade sections extending from the non-right-angled corner, and the platform can be angled horizontally relative to the hoist trolley so that it extends substantially in parallel with the second facade section.

Advantageously, the platform is pivoting 180° between the end positions, in such a manner that when the platform is at any of the end positions it can extend in parallel with a facade section extending from a right-angled corner of a building or a larger machine. In other words the platform may extend in a traditional manner out from the hoist trolley when it is adjusted in a central position, half way between the end positions, for enabling installation at a right-angled corner as well.

Furthermore, the advantage is achieved that the distance between the hoist trolley and the platform can be minimised when the platform is in said central position, which facilitates for a building worker on the platform to work on a building facade close to a mast. When the platform is to be turned from the central position to a position between the central position and any of the end positions, in accordance with the invention the position of the vertical axis first is adjusted so that the distance between the hoist trolley and the platform is increased. The required increase in distance depends on how broad the platform is.

The vertical axis is preferably adjustable at different distances from the hoist trolley and/or at different distances from the platform, as seen horizontally.

According to a preferred embodiment of the invention, the hoist system comprises a first coupling element coupled to the hoist trolley, and a second coupling element coupled to the platform, the second coupling element being articulately coupled to the first coupling element so that it is pivoting about said vertical axis.

To enable coupling of the platform to another hoist trolley on an adjacent mast by means of a further coupling element of the same kind as said first and second coupling elements, the platform is suitably articulately coupled to the second coupling element so that the platform is pivoting about a substantially horizontal axis. Since the hoist trolleys on two adjacent masts normally cannot be moved exactly synchronously with each other along the masts, the horizontal axis between the platform and the second coupling element at the respective masts allows that the platform can be tilted somewhat relative to the horizontal plane during hoisting or lowering, so that damaging stresses in the hoist system are avoided.

Preferably the first coupling element is articulately coupled to the hoist trolley so that it is pivoting about a further substantially horizontal axis, which further reduces the risk of damaging stresses arising in the hoist system, when a platform is moved along two adjacent masts.

The first coupling element may have at least two vertical bores situated at different distances from the hoist trolley, while the second coupling element may have at least one vertical bore spaced from the platform. Furthermore, an axle pin may releasably extend from any of the bores of the first coupling element and through the bore of the second coupling element, whereby the axle pin is coaxial with said vertical axis. Suitably, the bores of the first coupling element form a row of bores extending centrally out of the hoist trolley.

Figure 2:
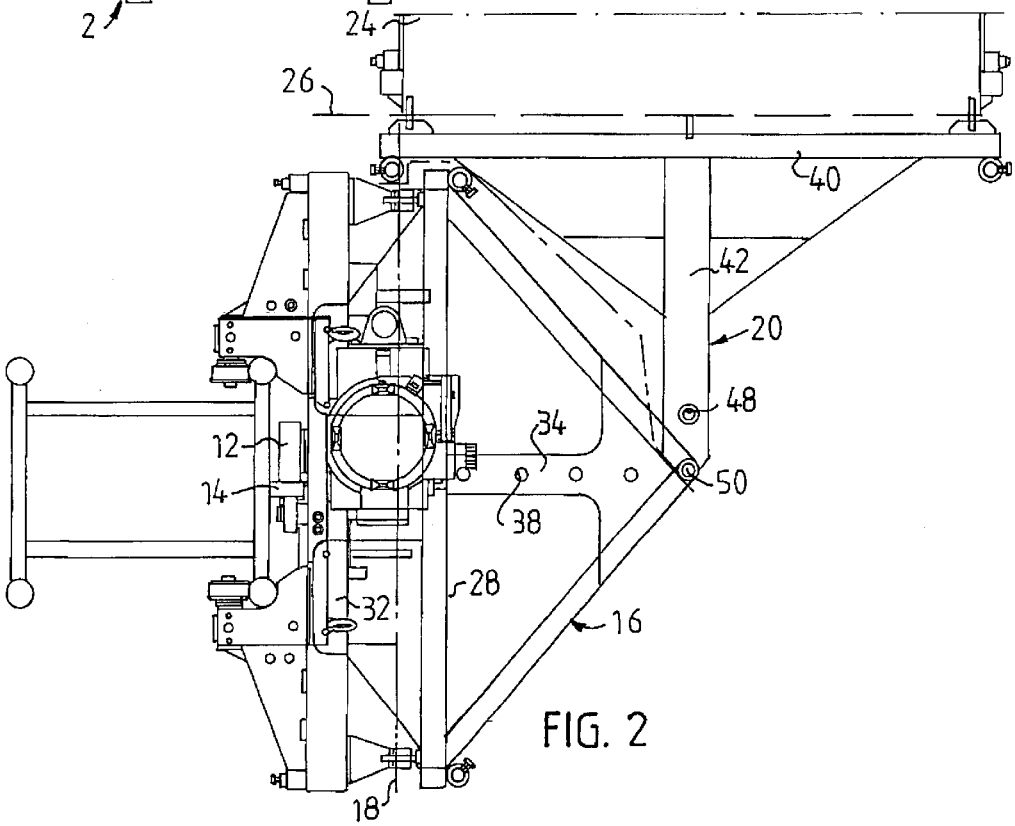
Figure 3:
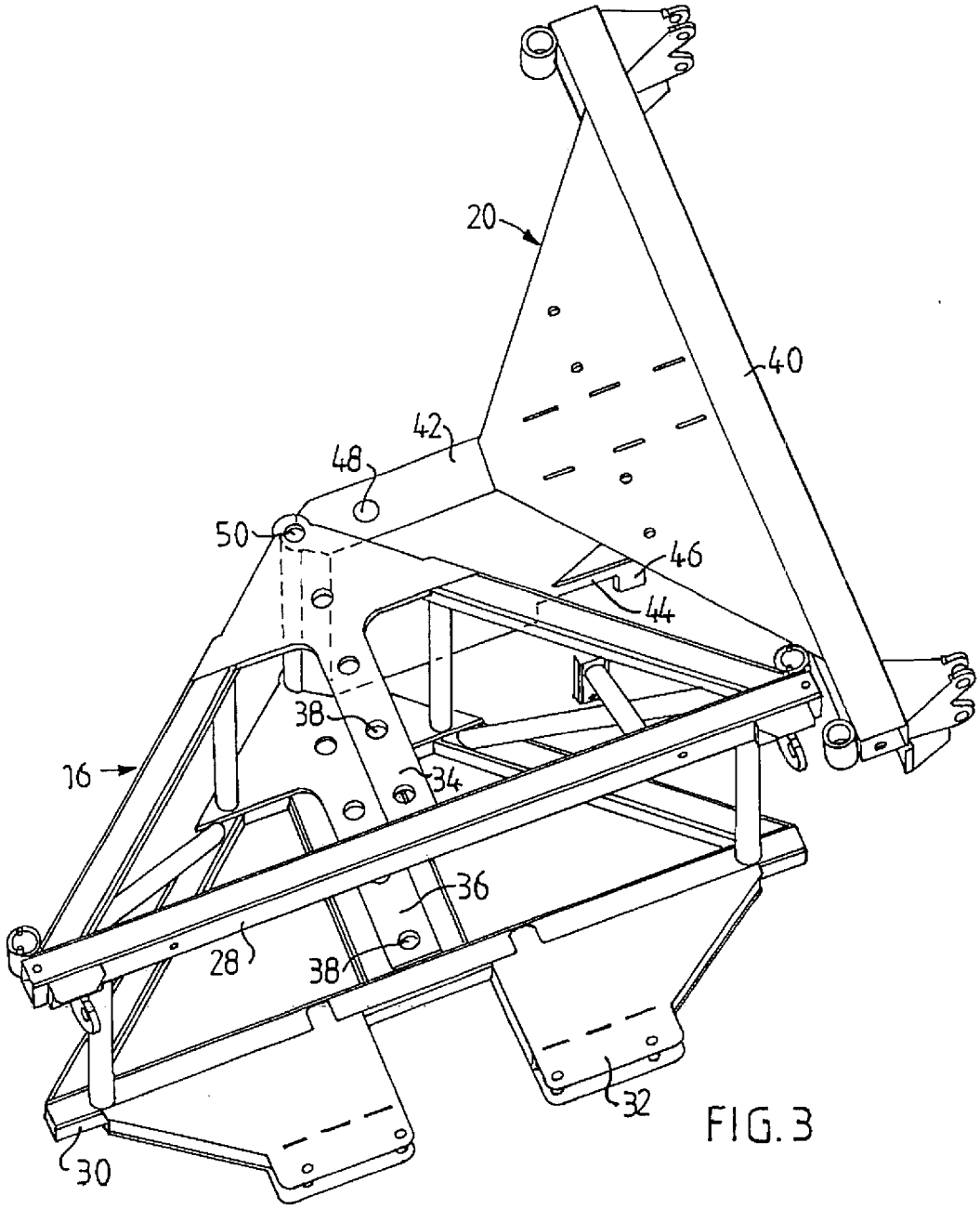
Figure 4:
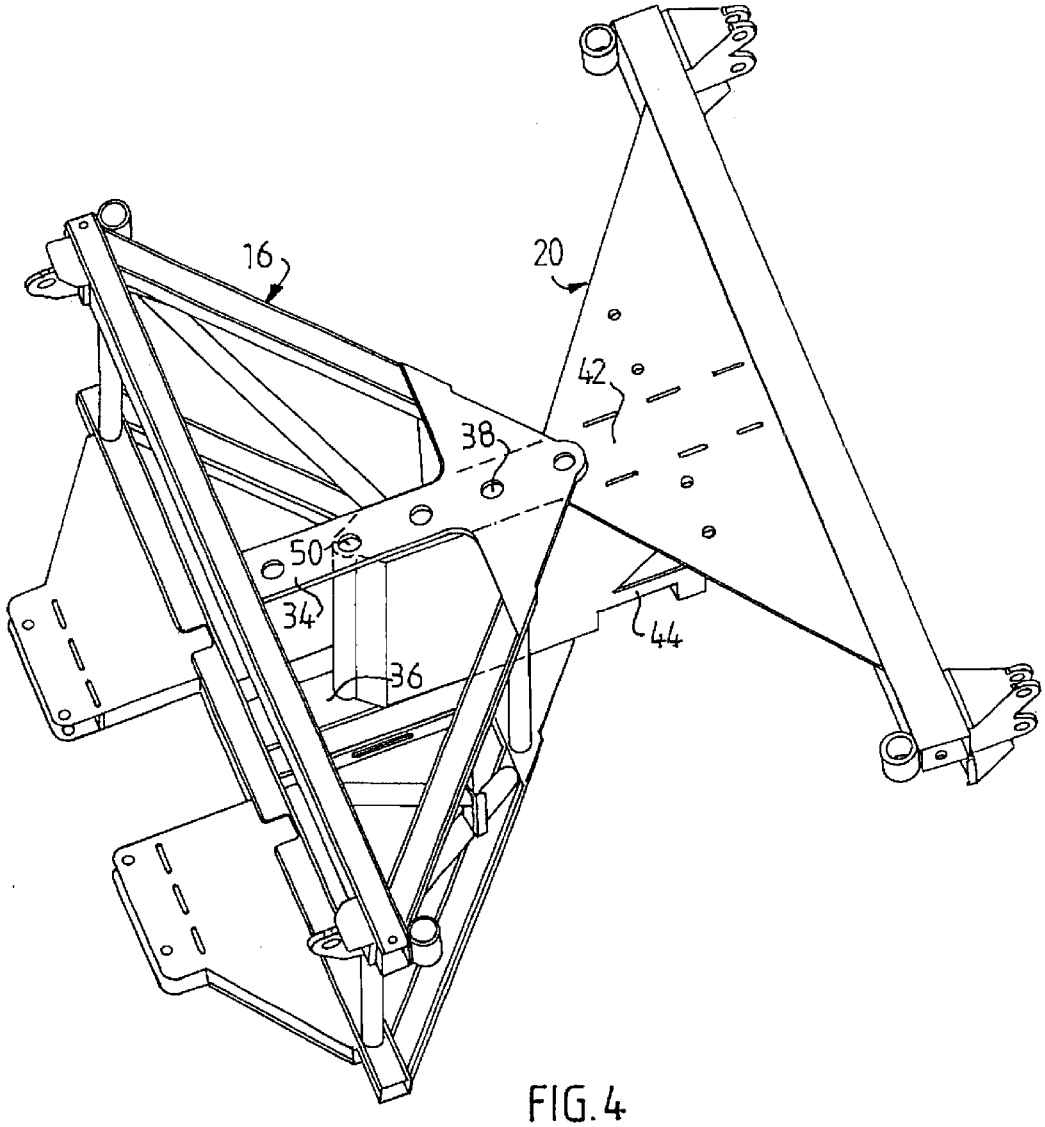
Figure 5:
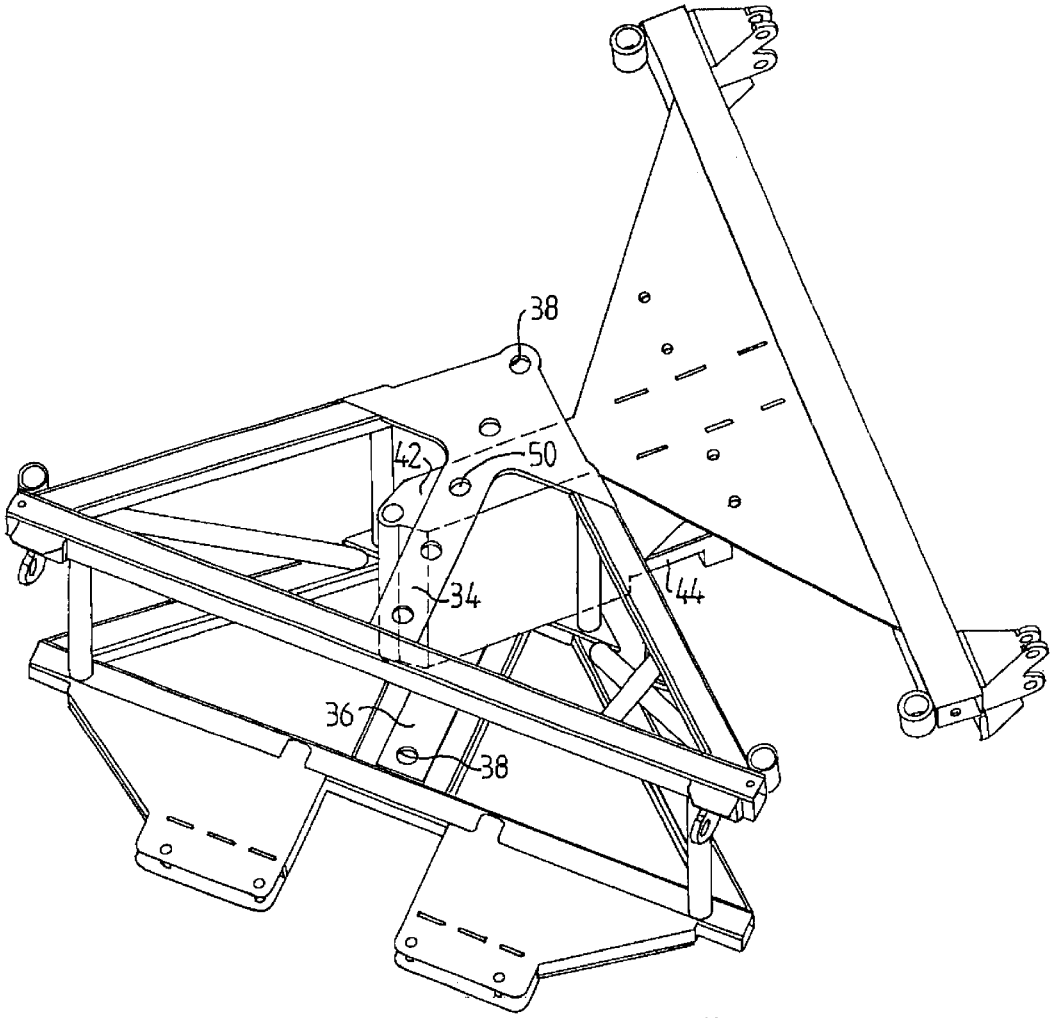

The invention is explained in more detail in the following with reference to the accompanying drawings in which FIG. 1 is a side view of a hoist trolley in the hoist system according to the invention, FIG. 2 is a view from above of the hoist trolley in FIG. 1 coupled to a platform by a coupling element of the hoist trolley and another coupling element of the platform, the platform being adjusted in an end position, so that it extends perpendicular to the front side of the hoist trolley, FIG. 3 shows a perspective view askew from above of the coupling elements of the hoist trolley and platform adjusted in a second end position opposite the end position illustrated in FIG. 2, FIG. 4 shows a perspective view askew from above of the coupling elements of the hoist trolley and platform adjusted in a central position, and FIG. 5 shows a perspective view askew from above of the coupling elements of the hoist trolley and platform adjusted in a position situated between the positions of the coupling elements shown in FIGS. 2 and 4.

In FIGS. 1 and 2 there is shown a hoist system according to the invention comprising a mast 2, and a hoist trolley 4, which by guide rollers 6 is moveable along vertical tubes 8 on the mast 2. The hoist trolley 4 is provided with a motor 10, which by a pinion 12 is in mesh with a rack 14 on the mast 2. A coupling element 16 is articulately coupled to the hoist trolley 4, so that it is pivoting about a horizontal axis 18, and extends out of the hoist trolley 4 and mast 2. A further coupling element 20 is articulately coupled to the coupling element 16, so that it is pivoting about a substantially vertical axis 22. A generally rectangular platform 24 is articulately coupled to the coupling element 20, so that it is pivoting about a substantially horizontal axis 26 at a short end of the platform 24.

The coupling element 16 and 20, respectively, is designed as a framework with a generally triangular shape as seen from above. The coupling element 16 comprises an upper horizontal crossbeam 28, which at its ends is journalled on the hoist trolley 4 to make the coupling elements 16 pivoting about the horizontal axis 18, and a lower crossbeam 30, which extends in parallel with the upper crossbeam 28 and which by fixing members 32 is yieldingly fixed to the hoist trolley 4. Thus, the fixing members 32 allow a certain limited pivoting of the coupling element 16 about the horizontal axis 18 from a normal position, in which the coupling element 16 is directed horizontally out of the hoist trolley 4 and mast 2. An upper centre beam 34 and a lower centre beam 36 extend in parallel with each other perpendicular out of the upper crossbeam 28 and the lower crossbeam 30, respectively. The centre beams 34, 36 are provided with bores 38, here five bores 38 in each centre beams 34 and 36, respectively, each bore 38 in the upper centre beam 34 being situated vertically aligned with a corresponding bore 38 in the lower centre beam 36.

The coupling element 20 comprises a horizontal crossbeam 40, which at its ends is journalled on the platform 24 at the short end thereof to make the platform 24 pivoting about the horizontal axis 26. An upper centre beam 42 extends perpendicular out of the crossbeam 40 to a free end. A lower centre beam 44 is attached to the upper centre beam 42 and extends in parallel with and under the latter to a free end situated under the crossbeam 40. The lower centre beam 44 is provided with fixing members 46 at its free end for fixing the platform 24 to a coupling element 20 in case the platform 24 only is to be carried by one single hoist trolley 4.

Also the centre beams 42 and 44 are provided with bores 48, here two bores in each centre beam 42 and 44, respectively, each bore 48 in the upper centre beam 42 being situated vertically aligned with a corresponding bore 48 in the lower centre beam 44. The centre beams 42 and 44 of the coupling element 20 of the platform 24 are located at somewhat shorter distance from each other than the centre beams 34 and 36 of the coupling element 16 of the hoist trolley 4, whereby the centre beams 42 and 44 are insertable between the centre beams 34 an 36. An axle pin 50 is insertable through any of the two pairs of bores 48 in the centre beams 42, 44 and any of the five pairs of bores 38 in the centre beams 34, 36, whereby said vertical axis 22 is formed coaxial with the axle pin 50. The axle pin 50 and the five pairs of bores 38 thus allow that the axis 22 may be arranged at five different distances from the hoist trolley 4. In the corresponding manner the axle pin 50 and the two pairs of bores 48 allow that the axis 22 is arranged at two different distances from the platform 24.

FIG. 3 illustrates how the axle pin So is inserted into the outermost pair of bores 38 on the centre beams 34, 36 and the outermost pair of bores 48 in the centre beams 42, 44, which allows pivoting of the platform 24 to an end position in which the platform 24 extends in parallel with the front side of the hoist trolley 4, i.e. opposite the side of the hoist trolley 4 facing the mast 2. The arrangement illustrated in FIG. 3 fits a straight-angled building corner.

FIG. 4 illustrates how the axle pin So is inserted into the innermost but one pair of bores 38 on the centre beams 34, 36 and the outermost but one pair of bores 48 in the centre beams 42, 44, which reduces the distance between the hoist trolley 4 and the platform 24 when the platform 24 is in the centre position shown in FIG. 4 in which the platform 24 extends perpendicular to the front side of the hoist trolley 4. The arrangement illustrated in FIG. 4 is suitable to install at a straight facade section that lacks corners.

FIG. 5 illustrates how the axle pin 50 is inserted in the central pair of bores 38 on the centre beams 34, 36 and in the innermost pair of bores 48 in the centre beams 42, 44, and how the platform is pivoted to a position in which it extends about 45° to the front side of the hoist trolley 4. The arrangement illustrated in FIG. 5 fits a building corner formed by facade sections that form an angle of 135° to each other.

For the sake of clarity certain details in the coupling element 16 are shown transparent in FIGS. 3–5. In reality these details are formed of plate material.

Of course, the platform 24 may be adjusted in any position relative to the hoist trolley 4 between the two end positions. With the aid of the bores 38 and 48, the distance between the hoist trolley 4 and the platform 24 can be made as small as possible for every adjusted position.

What is claimed is:

1. A hoist system, comprising:

at least one mast, a hoist trolley moveable externally along the mast, and a platform, which is articulately coupled to the hoist trolley so that it is horizontally pivoting about a substantially vertical axis between two end positions relative to the hoist trolley, the vertical axis being situated between the hoist trolley and the platform, as seen horizontally, wherein the position of the vertical axis is adjustable for adjusting the distance between the hoist trolley and the platform.

2. A hoist system according to claim 1, wherein the position of the vertical axis is adjustable at different distances from the hoist trolley as seen horizontally.

3. A hoist system according to claim 1, wherein the position of the vertical axis is adjustable at different distances from the platform as seen horizontally.

4. A hoist system comprising:

at least one mast, a hoist trolley moveable externally along the mast, a platform, which is articulately coupled to the hoist trolley so that it is horizontally pivoting about a substantially vertical axis between two end positions relative to the hoist trolley, the vertical axis being situated between the hoist trolley and the platform, as seen horizontally, the position of the vertical axis being adjustable at different distances from the platform as seen horizontally, for adjusting the distance between the hoist trolley and the platform, a first coupling element, which is coupled to the hoist trolley and which has at least two vertical bores situated at different distances from the hoist trolley, a second coupling element, which is coupled to the platform and which has a least one vertical bore spaced from the platform, and an axle pin releasably extending through any of the bores of the first coupling element and through the bore of the second coupling element, whereby the axle pin is coaxial with said vertical axis.

5. A hoist system according to claim 4, wherein the bores of the first coupling element form a row of bores extending centrally out of the hoist trolley.

6. A hoist system comprising:

at least one mast, a hoist trolley moveable externally along the mast, a platform, which is articulately coupled to the hoist trolley so that it is horizontally pivoting about a substantially vertical axis between two end positions relative to the hoist trolley, the vertical axis being situated between the hoist trolley and the platform, as seen horizontally, the position of the vertical axis being adjustable for adjusting the distance between the hoist trolley and the platform, a first coupling element coupled to the hoist trolley, and a second coupling element coupled to the platform, the second coupling element being articulately coupled to the first coupling element so that it is pivoting about said vertical axis.

7. A hoist system according to claim 6, wherein the platform is articulately coupled to the second coupling element so that it is pivoting about a substantially horizontal axis.

8. A hoist system according to claim 7, wherein the first coupling element is articulately coupled to the hoist trolley so that it is pivoting about a further substantially horizontal axis.

* * * * *